US008820891B2

(12) United States Patent
Bansyo

(10) Patent No.: US 8,820,891 B2
(45) Date of Patent: Sep. 2, 2014

(54) INKJET PRINTING APPARATUS

(71) Applicant: Riso Kagaku Corporation, Tokyo (JP)

(72) Inventor: Toshihiro Bansyo, Ibaraki (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 14/108,969

(22) Filed: Dec. 17, 2013

(65) Prior Publication Data

US 2014/0168306 A1 Jun. 19, 2014

(30) Foreign Application Priority Data

Dec. 19, 2012 (JP) ..... 2012-276337

(51) Int. Cl.
*B41J 2/21* (2006.01)
*B41J 2/045* (2006.01)

(52) U.S. Cl.
CPC ..... *B41J 2/04501* (2013.01)
USPC ..... 347/40

(58) Field of Classification Search
USPC ..... 347/40, 43, 47, 64–65
See application file for complete search history.

(56) References Cited

U.S. PATENT DOCUMENTS

| | | | | |
|---|---|---|---|---|
| 6,343,857 | B1 | 2/2002 | Cowger | |
| 7,445,316 | B2 * | 11/2008 | Hirayama | 347/58 |
| 7,971,950 | B2 * | 7/2011 | Lapstun et al. | 347/14 |
| 8,162,443 | B2 * | 4/2012 | Xie | 347/57 |
| 2012/0147096 | A1 | 6/2012 | Yamamoto | |
| 2013/0076838 | A1 | 3/2013 | Suzuki et al. | |

FOREIGN PATENT DOCUMENTS

| | | |
|---|---|---|
| EP | 1518685 | 3/2005 |
| JP | 07-251508 | 10/1995 |
| JP | 2009-285840 | 12/2009 |
| JP | 2012-125936 | 7/2012 |

OTHER PUBLICATIONS

Search report from E.P.O., mail date is Mar. 13, 2014.

* cited by examiner

*Primary Examiner* — Lamson Nguyen
(74) *Attorney, Agent, or Firm* — Greenblum & Bernstein, P.L.C.

(57) ABSTRACT

An inkjet printing apparatus includes two or more units. Each of the two or more units has a drive circuit, a nozzle row including a plurality of aligned nozzles configured to be driven by the drive circuit to eject ink, and an ink discharge passage configured to discharge a remainder of the ink supplied to the nozzles of the nozzle row from the nozzle row. The ink discharge passage of a first unit of the two or more units and the drive circuit of a second unit of the two or more units are thermally in contact with each other. The ink discharge passage of the second unit and the drive circuit of the first unit are thermally in contact with each other.

6 Claims, 6 Drawing Sheets

INKJET PRINTING APPARATUS

CROSS REFERENCE TO RELATED APPLICATION

This application is based upon and claims the benefit of priority from the prior Japanese Patent Application No. 2012-276337, filed on Dec. 19, 2012, the entire contents of which are incorporated herein by reference.

BACKGROUND

1. Technical Field

The present invention relates to an inkjet printing apparatus configured to form an image with ink ejected from nozzles.

2. Related Art

In inkjet printing apparatuses configured to form images with ink ejected from nozzles, it is necessary to prevent overheating of an actuator (for example, piezo element) of the nozzles for ejecting ink and overheating of a drive circuit of the actuator. This is because overheating of the actuator may increase the temperature of ink and thereby decrease the viscosity thereof, consequently inhibiting the ink from being ejected in a normal range, and because overheating of the drive circuit may cause a breakdown of the circuit.

Japanese Patent Application Publication Nos. Hei 7-251508, 2009-285840, and 2012-125936 describe devices in which ink is circulated and is used to cool heat generated by an actuator and a drive circuit.

SUMMARY

Meanwhile, along with an increase in the printing speed, the cooling effect achieved by merely circulating ink becomes insufficient. As a result, it is required that a thermoregulator be provided on the ink circulation path to cool ink, which causes increases in the size and cost of the apparatus.

An object of the present invention is to provide an inkjet printing apparatus having a high cooling efficiency by ink, and thereby enabling suppression of increases in the size and cost of the apparatus.

An inkjet printing apparatus in accordance with some embodiments includes two or more units. Each of the two or more units has a drive circuit, a nozzle row including a plurality of aligned nozzles configured to be driven by the drive circuit to eject ink, and an ink discharge passage configured to discharge a remainder of the ink supplied to the nozzles of the nozzle row from the nozzle row. The ink discharge passage of a first unit of the two or more units and the drive circuit of a second unit of the two or more units are thermally in contact with each other. The ink discharge passage of the second unit and the drive circuit of the first unit are thermally in contact with each other.

According to the above configuration, in each of the first unit and the second unit, one of ink which thermally comes into contact with an actuator of the nozzles and ink which thermally comes into contact with the drive circuit is ink of the first unit, and the other is ink of the second unit. Thus, the inks of the different units take individual roles of cooling heats of the actuator and the drive circuit generated in each of the units. Accordingly, the cooling efficiency by ink is increased, which enables suppression of increases in the size and cost of the apparatus.

Specifically, ink supplied to and discharged from the nozzle row of the first unit thermally comes into contact with the actuator of the nozzles of the first unit, whereas ink supplied to and discharged from the nozzle row of the second unit thermally comes into contact with the drive circuit of the first unit. Similarly, ink supplied to and discharged from the nozzle row of the second unit thermally comes into contact with the actuator of the nozzles of the second unit, whereas ink supplied to and discharged from the nozzle row of the first unit thermally comes into contact with the drive circuit of the second unit.

Thus, in the first unit, the actuator of the nozzles is cooled by the ink of the first unit, and the drive circuit is cooled by the ink of the second unit. On the other hand, in the second unit, the actuator of the nozzles is cooled by the ink of the second unit, and the drive circuit is cooled by the ink of the first unit.

Hence, the inks of different units take individual roles of cooling the actuators and the drive circuits that generate heats in each of the units. Accordingly, the cooling efficiency by ink is increased, which enables suppression of increases in the size and cost of the apparatus.

Each of the two or more units may have an ink circulation path configured to resupply the nozzles of the nozzle row with the remainder of the ink discharged from the nozzle row, and the ink discharge passage may be a part of the ink circulation path.

According to the above configuration, each unit has the ink circulation path configured to return the ink discharged from the nozzle row and supply the ink to the nozzle row. Hence, an ink discharge path, into which ink is discharged from the nozzle row, and which constitutes a part of the ink circulation path of each unit, is thermally in contact with the drive circuit of the other unit. This makes it possible to easily create a configuration in which inks of different units take individual roles of cooling the actuators and the drive circuits.

One of the first unit or the second unit may be a unit configured to eject ink from the nozzles in both a normal mode where applicable ink colors are all colors and a restriction mode where the applicable ink colors are restricted to some colors, and the other of the first unit or the second unit may be a unit configured to eject ink from the nozzles in the normal mode and refrain from ejecting ink from the nozzles in the restriction mode.

According to the above configuration, in the normal mode where all color inks are applicable, both of the first unit and the second unit eject ink from the nozzles. On the other hand, in the restriction mode where the applicable ink colors are restricted to some colors, one of the first unit and the second unit ejects ink from the nozzles, and the other refrains ejecting.

Hence, in the restriction mode, in one of the first unit and the second unit, the actuator of the nozzles is cooled by the ink of the own unit, and the drive circuit is cooled by the ink of the other unit where no heat is generated by the actuator of the nozzles and the drive circuit because the ink ejection is refrained.

In this manner, such a combination of the first unit and the second unit that one unit ejects ink but the other unit refrains ejecting in the restriction mode makes it possible to efficiently cool, by inks, the actuator and the drive circuit in the unit that particularly ejects ink in the restriction mode.

The inkjet printing apparatus may include inkjet heads arranged in first and second arrays, each of the inkjet heads being provided with the nozzle rows of at least the first unit and the second unit. The first and the second units of the inkjet head in each of the first and second arrays may be a combination of units configured to supply the nozzles with inks different in frequency of use in non-full color printing and discharge the inks from the nozzles.

According to the above configuration, in the first array of the inkjet heads and the second array of the inkjet heads provided with the nozzle rows of the first and the second units, inks different in frequency of use in the non-full color printing are supplied to and discharged from the respective nozzle rows of the first and the second units.

Hence, in the non-full color printing, there are likely to be cases where ink is ejected from only the nozzle rows of one type of unit in each array of the inkjet heads. In this case, in one of the first unit and the second unit in each array of the inkjet heads, the actuator of the nozzles is cooled by the ink of the own unit, and the drive circuit is cooled by the ink of the other unit where ink ejection is refrained and no heat is generated by the actuator of the nozzles and the drive circuit.

In this manner, such a combination of the first unit and the second unit configured to supply the nozzles with inks different in frequency of use in the non-full color printing and to discharging the inks from the nozzles makes it possible to efficiently cool, by inks, the actuator and the drive circuit in the unit that particularly ejects ink in the non-full color printing.

DETAILED DESCRIPTION

Figure 1:
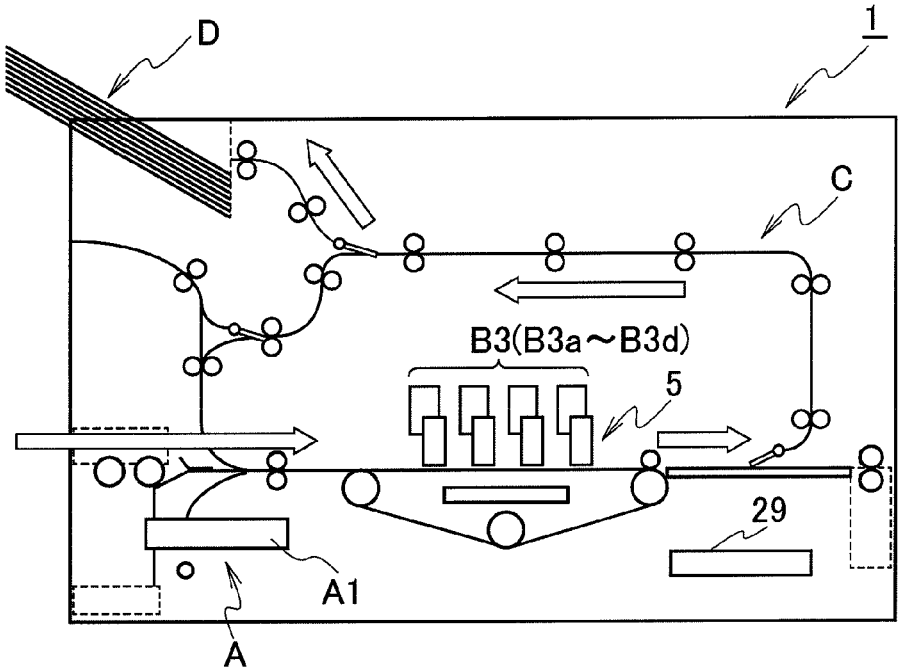
FIG. 1 is an explanatory drawing showing a schematic configuration of an inkjet printer according to one embodiment of the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Hereinafter, embodiments of the present invention will be described with reference to the drawings. FIG. 1 is an explanatory drawing showing a schematic configuration of an inkjet printer according to one embodiment of the present invention. As shown in FIG. 1, an inkjet printer 1 (inkjet printing apparatus) of the present embodiment includes a paper feed unit A, a printer unit B, a transfer unit C, a paper discharge unit D, an reverse unit E, and a control unit 29 configured to control operations of these units.

The paper feed unit A is configured to feed a print sheet PA (print paper). The paper feed unit A is disposed on the on the most upstream side of a transfer path of the print sheet PA. The paper feed unit A is configured to feed the print sheet PA from a paper feed tray A1 to the printer unit B.

The printer unit B is configured to print an image on the print sheet PA while conveying the print sheet PA to the transfer unit C. The printer unit B is disposed on the downstream side of the paper feed unit A. The printer unit B has a head unit B1 disposed above the transfer path of the print sheet PA. The head unit B1 includes four arrays of inkjet heads 5 and four ink-circulation type printer units B3 (B3*a* to B3*d*).

Figure 2:
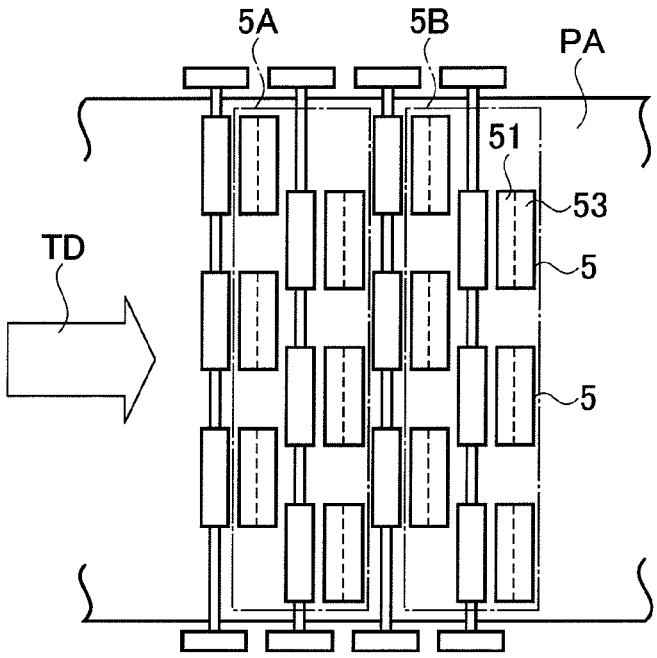
FIG. 2 is an explanatory drawing showing an arrangement of arrays of the inkjet heads in FIG. 1 from the above.

FIG. 2 is an explanatory drawing showing an arrangement of the arrays of the inkjet heads 5 in FIG. 1 from the above. As shown in FIG. 2, each array includes three inkjet heads 5 disposed apart from each other in a direction perpendicular to a transfer direction (arrow direction TD in FIG. 2) of the print sheet PA. The four arrays of the inkjet heads 5, 12 inkjet heads 5 in total, are arranged in a zigzag manner as a whole.

Six inkjet heads 5 disposed in a zigzag manner on the upstream side in the transfer direction constitute a first array of the inkjet heads 5A. Each of the inkjet heads 5 has a nozzle row configured to eject a C (cyan) ink and a nozzle row configured to eject a K (black) ink.

Six inkjet heads 5 disposed in a zigzag manner on the downstream side in the transfer direction constitute a second array of the inkjet heads 5B. Each of the inkjet heads 5 has a nozzle row configured to eject a M (magenta) ink and a nozzle row configured to eject a Y (yellow) ink.

As shown in FIG. 1, the ink-circulation type printer units B3 (B3*a* to B3*d*) respectively correspond to the arrays each constituted of three inkjet heads, and have the inkjet heads 5 of the corresponding arrays in ink circulation paths of the printer units B3 (B3*a* to B3*d*).

The transfer unit C constitutes a path, in the transfer path of the print sheet PA, through which the print sheet PA is conveyed to a portion where the paper discharge unit C is separated from the reverse unit E. The transfer unit C is configured to convey the printed print sheet PA. The transfer unit C is disposed on the downstream side of the printer unit B. The printed print sheet PA is discharged and stacked one after another on the paper discharge unit D. The paper discharge unit D is disposed on the downstream side of the transfer unit C.

In duplex printing, the paper discharge unit D is switched to the reverse unit E, to which the print sheet PA having one side printed is transferred. The reverse unit E is configured to reverse the print sheet PA having one side printed and convey the print sheet PA to the printer unit B.

Figure 3:
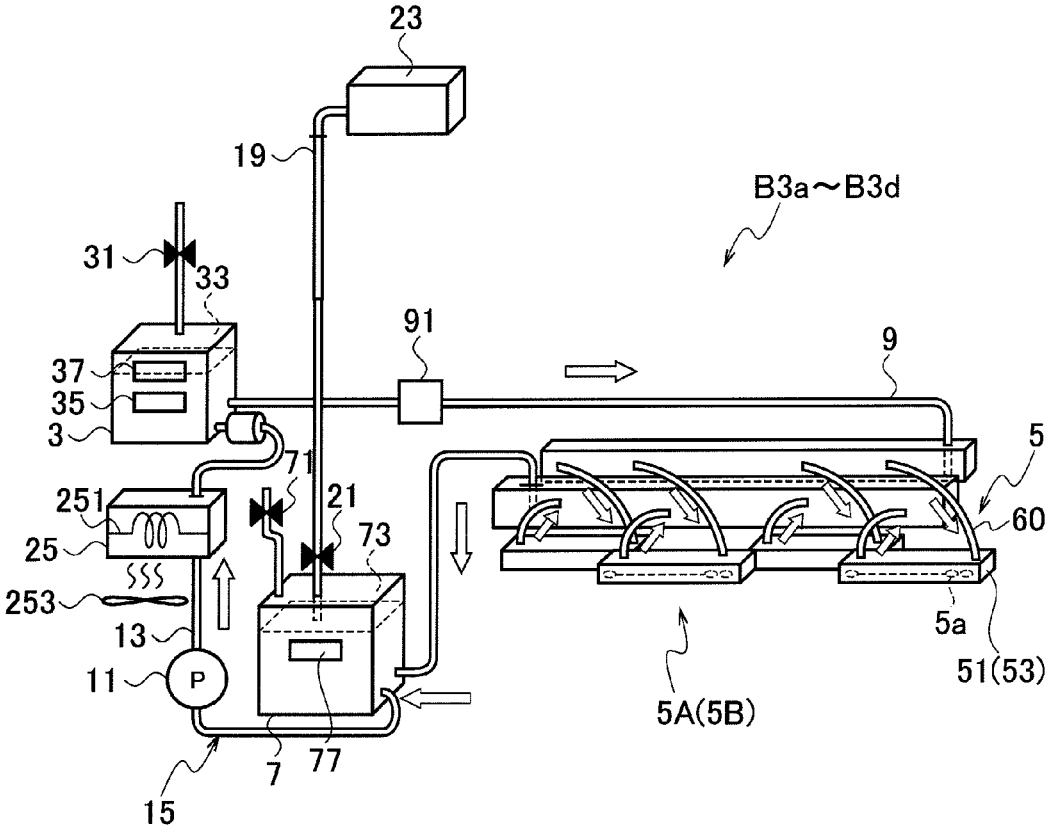
FIG. 3 is an explanatory drawing showing the entire configuration of ink-circulation type printer units in FIG. 1.

FIG. 3 is an explanatory drawing showing the entire configuration of the ink-circulation type printer units in FIG. 1. The ink-circulation type printer units B3*a* to B3*d* shown in FIG. 3 are configured to print an image on the print sheet PA using C (cyan), K (black), M (magenta), and Y (yellow) color inks.

Each of the ink-circulation type printer units B3*a* to B3*d* in FIG. 3 has an ink circulation path 15. The ink circulation path 15 includes an ink flow path 9 extending from an upper tank 3 to an lower tank 7 via six inkjet heads 5 constituting the first or the second array of the inkjet head 5A or 5B, and an ink flow path 13 extending from the lower tank 7 to the upper tank 3 via a circulation pump 11.

The upper tank 3 has therein an air layer 33 communicating with the atmosphere via an atmosphere opening valve 31. The air layer 33 is provided as a buffer configured to buffer a pulsation caused by the pressure of ink circulating in the ink circulation path 15 as the circulation pump 11 is activated, and to stabilize the pressure of ink meniscuses in nozzles 5*a*, 5*a*, . . . , which are provided to each of the six inkjet heads 5, to which ink is supplied, and from which the ink is discharged. The upper tank 3 is provided with two liquid surface sensors 35, 37 configured to respectively detect the highest value and the limit value higher than the highest value of the liquid surface of ink inside the upper tank 3.

The ink flow path 9 is provided with a temperature sensor 91 configured to detect the temperature of ink passing through the ink flow path 9. The six inkjet heads 5 are disposed below the upper tank 3.

Each of the inkjet heads 5 is constituted of two integrated blocks, called a first block 51 and a second block 53. Of the two, the first block 51 (or the second block 53) is provided with multiple nozzles 5*a*, to each of which ink is supplied from the upper tank 3 through the ink flow path 9 by the pressure according to a difference in hydraulic head between the liquid surface of ink in the upper tank 3 and the ink meniscus in the nozzle.

The lower tank 7 is disposed below the inkjet heads 5. Surplus ink (remainder of the ink) remained after ejection from the nozzles 5*a* is collected from the inkjet head 5 into the lower tank 7 by the own weight of the ink. The lower tank 7 has therein an air layer 73 communicating with the atmosphere via an atmosphere opening valve 71. The air layer 73 is provided so that the pressure of ink meniscuses in the nozzles 5*a* may be stabilized by the atmospheric pressure while the ink circulation in the ink circulation path 15 is stopped.

The lower tank 7 is provided with a liquid surface sensor 77 configured to detect the lowest value of the liquid surface of ink inside the lower tank 7. The lower tank 7 is connected to an ink cartridge 23 via a supply ink flow path 19 and an open/close valve 21.

The ink cartridge 23 for each of the ink-circulation type printer units B3*a* to B3*d* is filled with process-color C (cyan), K (black), M (magenta), and Y (yellow) inks.

When the liquid surface sensor 77 detects that the liquid surface of ink in the lower tank 7 is lowered to the lowest value, the open/close valve 21 is opened as appropriate, and an appropriate amount of ink in the ink cartridge 23 is supplied to the lower tank 7 through the supply ink flow path 19.

The circulation pump 11 is configured to return ink in the lower tank 7 to the upper tank 3 through the ink flow path 13. In the ink flow path 13, a temperature regulator 25 is provided. The temperature regulator 25 is configured to regulate the temperature of ink to be returned from the lower tank 7 to the upper tank 3 by the circulation pump 11 in such a manner that the ink in the inkjet head 5 has a suitable temperature for ejection from the nozzles 5*a* at an appropriate ejection speed. For this purpose, the temperature regulator 25 has a heater 251 for heating, a fan 253 for cooling, and a heat sink.

Figure 4A:
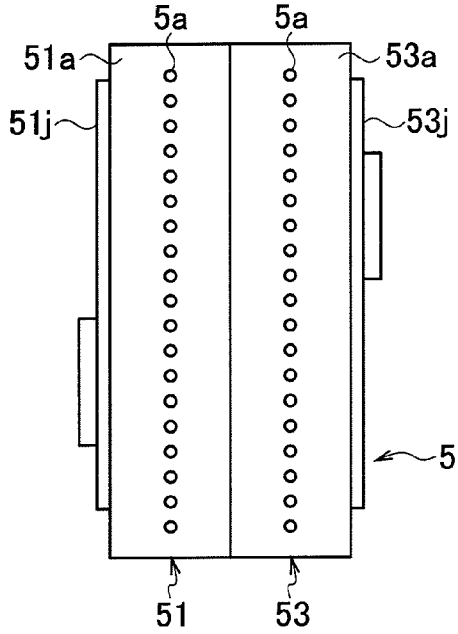
FIG. 4A is a bottom view of an inkjet head in FIG. 2.
Figure 4B:
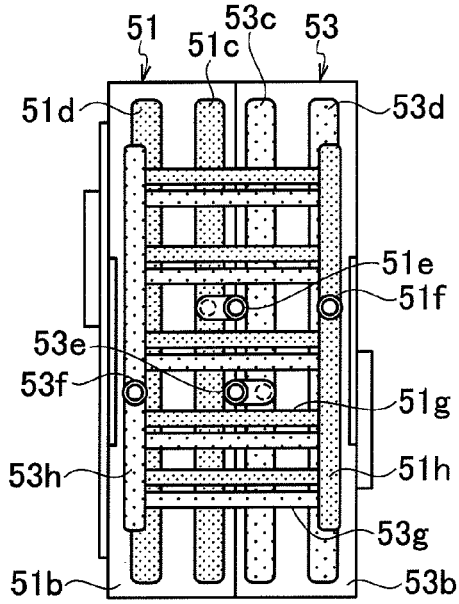
FIG. 4B is a schematic view showing an ink flow path configuration inside the inkjet head in FIG. 2.
Figure 4C:
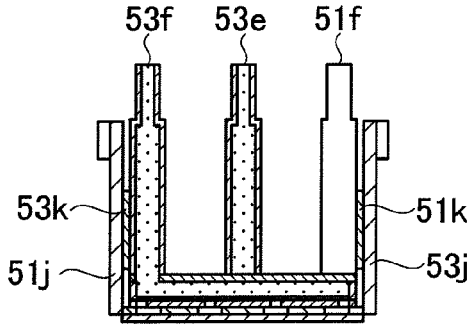
FIG. 4C is a vertical cross-sectional view of the inkjet head in FIG. 2.

FIG. 4A is a bottom view of the inkjet head 5, FIG. 4B is a schematic view showing an ink flow path configuration inside the inkjet head 5, and FIG. 4C is a vertical cross-sectional view of the inkjet head 5. As shown in FIG. 4A, the two blocks, called the first block 51 and the second block 53, constituting the inkjet head 5 have first and second nozzle plates 51*a*, 53*a* on the respective bottom surfaces of the blocks. The nozzle plates 51*a*, 53*a* are provided with multiple rows of nozzles 5*a* communicating with ink chambers (unillustrated) inside the inkjet head 5.

It should be noted that, in the present embodiment to be illustrated below, description will be given of a case where the color of ink ejected from the nozzles 5*a* of the first block 51 is different from that of ink ejected from the nozzles 5*a* of the second block 53. Nevertheless, the present invention is applicable also to a case where the inks ejected from the nozzles 5*a* of the blocks 51, 53 have the same color.

In a case where the inkjet head 5 is of shear mode type, when partition walls (unillustrated) of the ink chambers communicating with the nozzles 5*a* are subjected to shearing deformation by applying voltage to piezoelectric members (unillustrated) constituting the partition walls, ink is eject from the nozzles 5*a*.

As shown in FIG. 4B, first and second ink flow path members 51*b*, 53*b* are stacked on the first and the second nozzle plates 51*a*, 53*a*. The first and the second ink flow path members 51*b*, 53*b* are respectively provided with first and second ink supply passages 51*c*, 53*c* and first and second ink discharge passages 51*d*, 53*d* in parallel with the rows of the nozzles 5*a*. Through the first and second ink supply passages 51*c*, 53*c*, ink is supplied to the multiple nozzles 5*a* in the first and the second nozzle plates 51*a*, 53*a*. Into the first and second ink discharge passages 51*d*, 53*d*, ink is discharged from the multiple nozzles 5*a* in the first and the second nozzle plates 51*a*, 53*a*.

A first ink supply port 51*e* is connected to the first ink supply passage 51*c*. A first ink discharge port 51*f* is connected to the first ink discharge passage 51*d* through communication passages 51*g*, 51*h*. Similarly, a second ink supply port 53*e* is connected to the ink supply passage 53*c*. A second ink discharge port 53*f* is connected to the second ink discharge passage 53*d* through communication passages 53*g*, 53*h*.

Figure 5A:
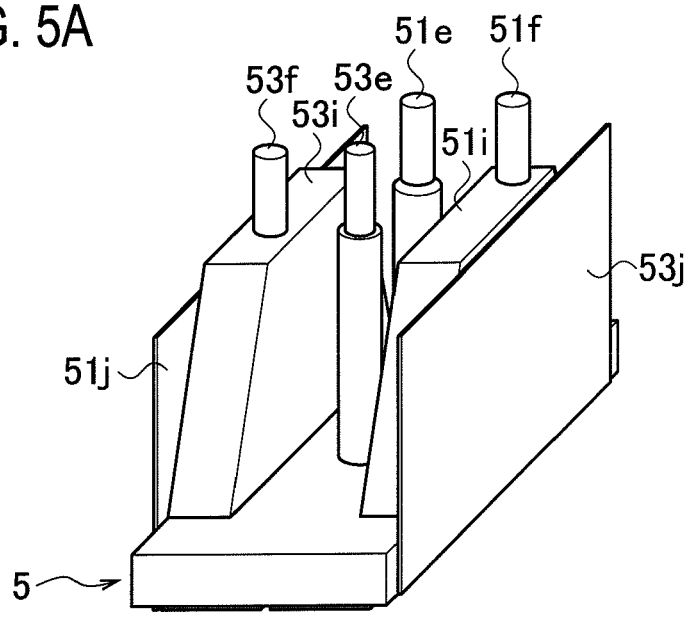
FIG. 5A is a perspective view showing the inkjet head in FIG. 2 from the above.
Figure 5B:
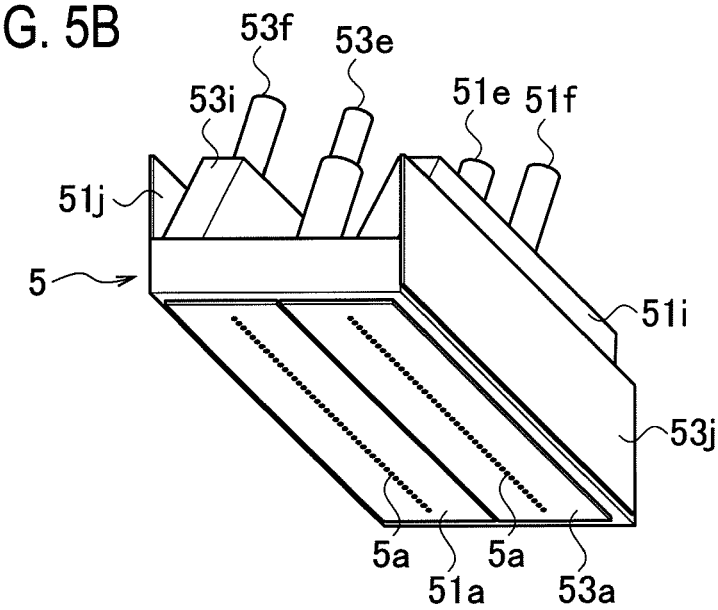
FIG. 5B is a perspective view showing the inkjet head in FIG. 2 from the below.

FIG. 5A is a perspective view showing the inkjet head in FIG. 2 from the above, and FIG. 5B is a perspective view showing the inkjet head in FIG. 2 from the below. As shown in FIG. 5A, the first and the second ink supply ports 51*e*, 53*e* are disposed at a boundary portion between the first block 51 and the second block 53 of the inkjet head 5. The first and the second ink discharge ports 51*f*, 53*f* are disposed at the respective ends in a width direction of the inkjet head 5, which is perpendicular to a longitudinal direction thereof (a row direction of the nozzles 5*a*).

As shown in FIG. 5A, the first and the second ink discharge ports 51*f*, 53*f* communicate with the first and the second ink discharge passages 51*d*, 53*d* via trapezoidal, hollow first and second ink collectors 51*i*, 53*i* configured to collect inks discharged from the entire first and the second ink discharge passages 51*d*, 53*d* shown in FIG. 4B.

On an outer surface of the first ink collector 51*i*, a board 53*j* of a second drive circuit is attached, which is configured to apply voltage to the piezoelectric member of the second block 53 to deform the partition wall of the ink chamber. Similarly, on an outer surface of the second ink collector 53*i*, a board 51*j* of a first drive circuit is attached, which is configured to apply voltage to the piezoelectric member of the first block 51 to deform the partition wall of the ink chamber.

As shown in FIG. 4*c*, the boards 51*j*, 53*j* of the first and the second drive circuits are respectively attached to the target second and first ink collectors 53*i*, 51*i* with joining members 51*k*, 53*k* made of a metal or resin having a favorable thermal conductivity in between. Thereby, the boards 51*j*, 53*j* of the first and the second drive circuits are thermally in contact with the second and the first ink collectors 53*i*, 51*i*. In other words, the first ink discharge passage 51*d* and the board 53*j* of the second drive circuit are thermally in contact with each other with the first ink collector 51*i*, whereas the second ink discharge passages 53*d* and the board 51*j* of the first drive circuit are thermally in contact with each other with the second ink collector 53*i*.

Figure 6:
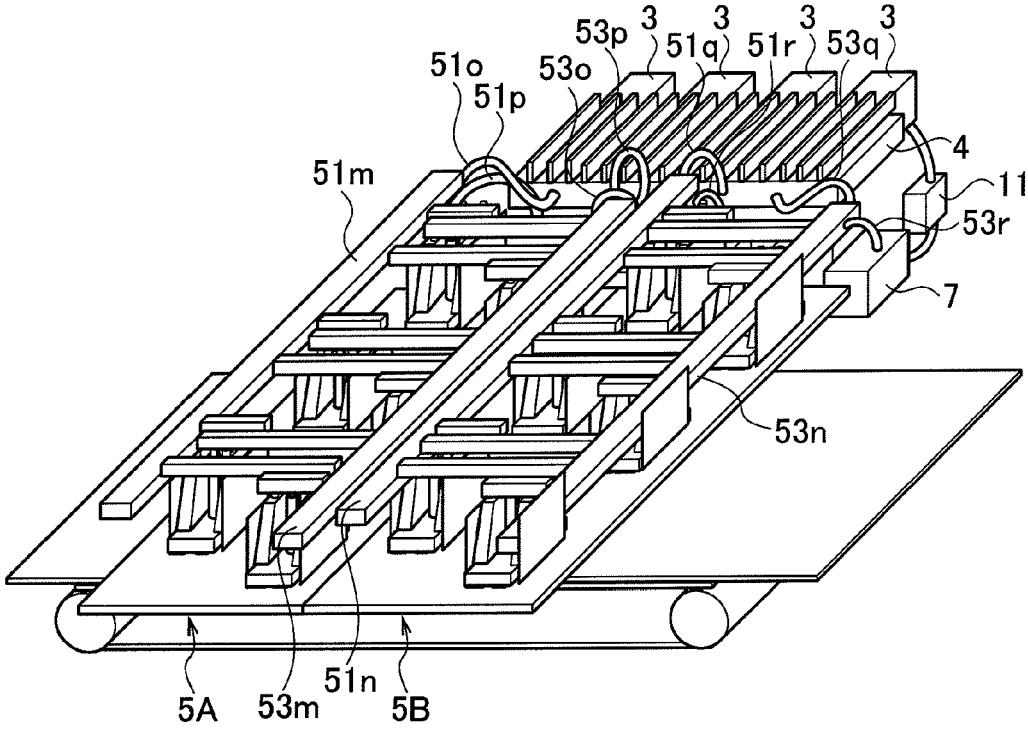
FIG. 6 is a perspective view showing ink circulation paths of first and second arrays of the inkjet heads.

FIG. 6 is a perspective view showing the ink circulation paths 15 of the inkjet heads 5 of the first and the second arrays of the inkjet heads 5A, 5B.

In the present embodiment, a K (black) ink bus 51*m* is wired to the first blocks 51 of the inkjet heads 5 in the first array of the inkjet heads 5A, while a C (cyan) ink bus 53*m* is wired to the second blocks 53.

A K (black) ink is ejected from the nozzles 5*a* in both full color printing (normal mode) and non-full color printing (restriction mode). On the other hand, a C (cyan) ink is ejected from the nozzles 5*a* in the full color printing (normal mode), but may not be ejected from the nozzles 5*a* in the non-full color printing (restriction mode). In other words, the K (black) ink is ink used more frequently than the C (cyan) ink.

In the present embodiment, a M (magenta) ink bus 51*n* is wired to the first blocks 51 of the inkjet heads 5 in the second array of the inkjet heads 5B, while a Y (yellow) ink bus 53*n* is wired to the second blocks 53.

A Y (yellow) ink is ejected from the nozzles 5*a* in both the full color printing (normal mode) and the non-full color printing (restriction mode). On the other hand, a M (magenta) ink is ejected from the nozzles 5*a* in the full color printing (normal mode), but may not be ejected from the nozzles 5*a* in the non-full color printing (restriction mode). In other words, the Y (yellow) ink is ink used more frequently than the M (magenta) ink.

The ink buses 51*m*, 51*n* for the first and the second arrays of the inkjet heads 5A, 5B respectively house portions of supply pipes 51*o*, 53*o* connected to the first ink supply port 51*e* of the first block 51 shown in FIGS. 4B and 5A, and portions of discharge pipes 51*p*, 53*p* connected to the first ink discharge port 51*f*.

The ink buses 53*m*, 53*n* for the first and the second arrays of the inkjet heads 5A, 5B respectively house portions of supply pipes 51*q*, 53*q* connected to the second ink supply port 53*e* of the second block 53 shown in FIGS. 4B and 5A, and portions of discharge pipes 51*r*, 53*r* connected to the second ink discharge port 53*f*.

The supply pipes 51*o*, 53*o*, 51*q*, 53*q* for the first and the second arrays of the inkjet heads 5A, 5B are respectively connected to the upper tanks 3 of the ink-circulation type printer units B3*a* to B3*d* via a heat exchanger 4.

The discharge pipes 51*p*, 53*p*, 51*r*, 53*r* for the first and the second arrays of the inkjet heads 5A, 5B are respectively connected to the circulation pumps 11 or the lower tanks 7 of the ink-circulation type printer units B3*a* to B3*d* via the heat exchanger 4.

According to the inkjet printer 1 of the present embodiment having the above-described configuration, in the first and the second arrays of the inkjet heads 5A, 5B, ink supplied to and discharged from the rows of the nozzles 5*a* of the first units 51 thermally comes into contact with the piezoelectric elements (unillustrated) of the ink chambers communicating with the nozzles 5*a* of the first units 51, whereas ink supplied to and discharged from the rows of the nozzles 5*a* of the second units 53 thermally comes into contact with the boards 51*j* of the drive circuits of the first units 51.

Similarly, ink supplied to and discharged from the rows of the nozzles 5*a* of the second units 53 thermally comes into contact with the piezoelectric elements (unillustrated) of the ink chambers communicating with the nozzles 5*a* of the second units 53, whereas ink supplied to and discharged from the rows of the nozzles 5*a* of the first units 51 thermally comes into contact with the boards 53*j* of the drive circuits of the second units 53.

Thus, in the first unit 51, the piezoelectric element of the ink chamber is cooled by the ink of the first unit 51, and the board 51*j* of the drive circuit is cooled by the ink of the second unit 53. On the other hand, in the second unit 53, the piezoelectric element of the ink chamber is cooled by the ink of the second unit 53, and the board 53*j* of the drive circuit is cooled by the ink of the first unit 51.

Hence, the inks of the two units 51, 53 take individual roles of cooling the piezoelectric elements of the ink chambers and the boards 51*j*, 53*j* of the drive circuits that generate heats in the respective units 51, 53. Accordingly, the cooling efficiency by ink is increased, and the burden of the temperature regulators 25 of the ink-circulation type printer units B3*a* to B3*d* is reduced, which enables suppression of increases in the size and cost of the temperature regulators 25 or the entire inkjet printer 1.

Moreover, according to the inkjet printer 1 of the present embodiment, the boards 53*j*, 51*j* of the drive circuits of the units 53, 51 are respectively attached to the first and the second ink collectors 51*i*, 53*i* of the first and the second ink discharge port 51*f*, 53*f* of the other units 51, 53, so that the corresponding two are thermally in contact with each other. This makes it possible to easily create a configuration in which inks of the two units 51, 53 take individual roles of cooling the piezoelectric elements and the boards 51*j*, 53*j* of the drive circuits.

Note that, in the inkjet printer 1 of the present embodiment, when the inks discharged from the rows of the nozzles 5*a* of the units 51, 53 thermally come into contact with and cool the piezoelectric elements of the ink chambers or the boards 51*j*, 53*j* of the drive circuits, the inks absorb the heats therefrom. Further, inks to be supplied to the rows of the nozzles 5*a* of the units 51, 53 are regulated by the temperature regulator 25 to such a temperature as to have a viscosity allowing appropriate eject characteristics.

Furthermore, in the first and the second arrays of the inkjet heads 5A, 5B according to the inkjet printer 1 of the present embodiment, when inks in the supply pipes 51*o*, 53*o*, 51*q*, 53*q* and the discharge pipes 51*p*, 53*p*, 51*r*, 53*r* for the first and the second units 51, 53 pass through the heat exchanger 4, heat is exchanged between the inks.

Thus, since the heat is exchanged between the inks in the ink circulation paths 15 of the units 51, 53 by means of the heat exchanger 4, it is possible to increase the heat utilization efficiency by utilizing the inks supplied to the rows of the nozzles 5*a* in the units 51, 53 as the heat source at the time of the regulation to an appropriate temperature.

In addition to this, when the inks of the different units 51, 53 take the individual roles of cooling the piezoelectric elements of the ink chambers and the boards 51*j*, 53*j* of the drive circuits, even if the inks receive different heat values therefrom, these inks exchange heats with ink in another the ink circulation path 15 in the heat exchanger 4, thus leveling the burden for cooling by the inks of the units 51, 53. This makes it possible to increase the efficiency of cooling the piezoelectric elements of the ink chambers and the boards 51*j*, 53*j* of the drive circuits by the inks in each of the units 51, 53.

Moreover, in the first and the second arrays of the inkjet heads 5A, 5B according to the inkjet printer 1 of the present embodiment, in non-full color printing in which only inks of some colors among C (cyan), K (black), M (magenta), and Y (yellow) are used, there is a case where the inks are ejected from the nozzles 5*a* in the first units 51 but such ejection is refrained (stopped) in the second units 53.

Hence, in such non-full color printing, in the first unit 51, the piezoelectric element of the ink chamber is cooled by the ink of the first unit 51, and the board 51*j* of the drive circuit is cooled by the ink of the second unit 53 where no heat is generated by the piezoelectric element of the ink chamber and the board 53*j* of the drive circuit because the ink ejection is refrained.

In this manner, such a combination of the first unit 51 and the second unit 53 that one unit ejects ink but the other unit may refrain ejecting in non-full color printing makes it possible to efficiently cool, by inks, the piezoelectric element of the ink chamber and the board 51*j* of the drive circuit in the first unit 51 that particularly ejects ink in the non-full color printing.

Figure 7:
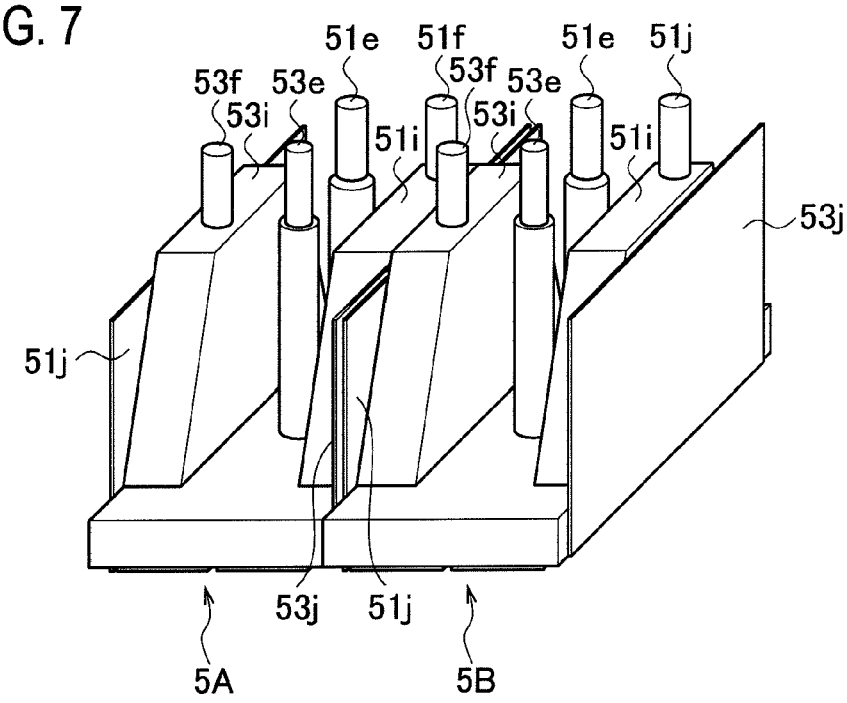
FIG. 7 is an explanatory view for illustrating a case where the inkjet heads in the first and the second arrays are integrated together.

Additionally, in the present embodiment, the inkjet heads 5 in the first and the second arrays of the inkjet heads 5A, 5B are disposed apart from each other as shown in FIGS. 2 and 6. However, for example, as shown in a perspective view of FIG. 7, the inkjet heads 5 in the first and the second arrays of the inkjet heads 5A, 5B may be integrated together. Such a configuration enables an inkjet head 5 configured to eject C (cyan), K (black), M (magenta), and Y (yellow) inks from nozzles 5*a* in one block.

Meanwhile, in the present embodiment, the rows of the nozzles 5*a* of the two units 51, 53 are provided in one inkjet head 5. Nevertheless, it is possible to create a configuration in which the rows of the nozzles 5*a* of the first and the second units 51, 53 are provided in different inkjet heads 5 from each other.

Figure 8:
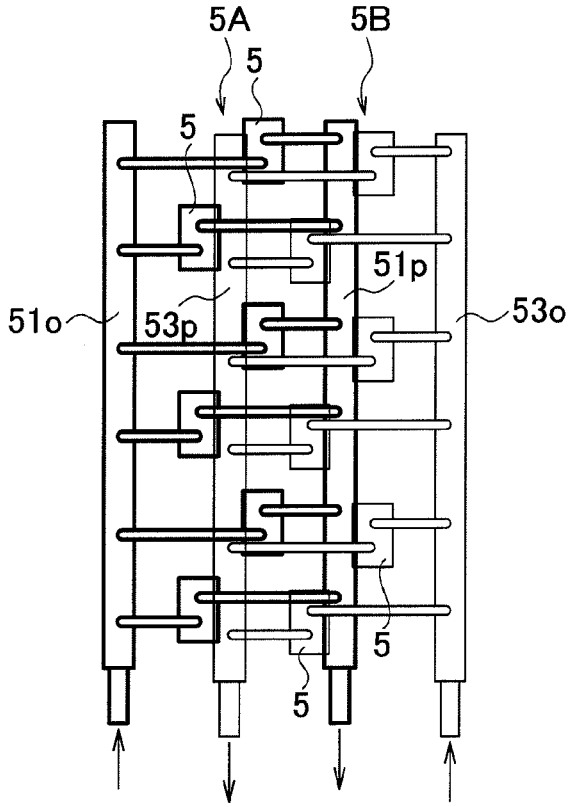
FIG. 8 is an explanatory drawing showing an arrangement of supply pipes and discharge pipes for first and second units in a case where each inkjet head in the first array of the inkjet heads is provided with a nozzle row of the first unit while each inkjet head in the second array of the inkjet heads is provided with a nozzle row of the second unit.

FIG. 8 is an explanatory drawing showing an arrangement of the supply pipes 51*o*, 53*o* and the discharge pipes 51*p*, 53*p* for the units 51, 53 in a case where each inkjet head 5 in the first array of the inkjet heads 5A is provided with the row of the nozzles 5*a* of the first unit 51 while each inkjet head 5 in the second array of the inkjet heads 5B is provided with the row of the nozzles 5*a* of the second units 53.

In this case, the inkjet heads 5 are respectively provided with the boards (unillustrated) of the drive circuits of the piezoelectric elements of the ink chambers communicating with the nozzles 5*a*. Then, the discharge pipe 53*p* for the second array of the inkjet heads 5B is disposed in contact with the boards of the inkjet heads 5 in the first array of the inkjet heads 5A. Moreover, the discharge pipe 51*p* for the first array of the inkjet heads 5A is disposed in contact with the boards of the inkjet heads 5 in the second array of the inkjet heads 5B.

With the above-described configuration, in the first array of the inkjet heads 5A, ink supplied to and discharged from the rows of the nozzles 5*a* thermally comes into contact with the piezoelectric elements (unillustrated) of the ink chambers, whereas ink supplied to and discharged from the rows of the nozzles 5*a* in the second array of the inkjet heads 5B thermally comes into contact with the boards of the drive circuits.

Similarly, in the second array of the inkjet heads 5B, ink supplied to and discharged from the rows of the nozzles 5*a* thermally comes into contact with the piezoelectric elements (unillustrated) of the ink chambers, whereas ink supplied to and discharged from the rows of the nozzles 5*a* in the first array of the inkjet heads 5A thermally comes into contact with the boards of the drive circuits.

Thus, in the first array of the inkjet heads 5A, the piezoelectric elements of the ink chambers are cooled by the ink flowing through the inkjet heads 5 in the first array of the inkjet head 5A, and the boards of the drive circuits are cooled by the ink flowing through the inkjet heads 5 in the second array of the inkjet heads 5B.

On the other hand, in the second array of the inkjet heads 5B, the piezoelectric elements of the ink chambers are cooled by the ink flowing through the inkjet heads 5 in the second array of the inkjet heads 5B, and the boards of the drive circuits are cooled by the ink flowing through the inkjet heads 5 in the first array of the inkjet heads 5A.

With such a configuration also, as in the above-described embodiment, the inks flowing through the inkjet heads 5 in the respective arrays of the inkjet heads 5A, 5B take individual roles of cooling the piezoelectric elements of the ink chambers and the boards of the drive circuits that generate heats in the first and the second arrays of the inkjet heads 5A, 5B. Accordingly, the cooling efficiency by ink is increased, and the burden of the temperature regulators 25 of the ink-circulation type printer units B3*a* to B3*d* is reduced, which enables suppression of increases in the size and cost of the temperature regulators 25 or the entire inkjet printer 1.

It should be noted that the embodiment has been described so far by taking as an example the line-type inkjet printer 1 having the inkjet heads 5. Nevertheless, the present invention is applicable also to serial-type inkjet printers configured to print the print sheet PA conveyed in a sub-scanning direction while the inkjet heads reciprocate in a main scanning direction.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. An inkjet printing apparatus comprising two or more units each having a drive circuit, a nozzle row including a plurality of aligned nozzles configured to be driven by the drive circuit to eject ink, and an ink discharge passage configured to discharge a remainder of the ink supplied to the nozzles of the nozzle row from the nozzle row, wherein the ink discharge passage of a first unit of the two or more units and the drive circuit of a second unit of the two or more units are thermally in contact with each other, and the ink discharge passage of the second unit and the drive circuit of the first unit are thermally in contact with each other.

2. The inkjet printing apparatus according to claim 1, wherein each of the two or more units has an ink circulation path configured to resupply the nozzles of the nozzle row with the remainder of the ink discharged from the nozzle row, and the ink discharge passage is apart of the ink circulation path.

3. The inkjet printing apparatus according to claim 1, wherein one of the first unit or the second unit is a unit configured to eject ink from the nozzles in both a normal mode where applicable ink colors are all colors and a restriction mode where the applicable ink colors are restricted to some colors, and the other of the first unit or the second unit is a unit configured to eject ink from the nozzles in the normal mode and refrain from ejecting ink from the nozzles in the restriction mode.

4. The inkjet printing apparatus according to claim 1, comprising inkjet heads arranged in first and second arrays, each of the inkjet heads being provided with the nozzle rows of at least the first unit and the second unit, wherein the first and the second units of the inkjet head in each of the first and second arrays are a combination of units configured to supply the nozzles with inks different infrequency of use in non-full color printing and discharge the inks from the nozzles.

5. The inkjet printing apparatus according to claim 2, comprising inkjet heads arranged in first and second arrays, each of the inkjet heads being provided with the nozzle rows of at least the first unit and the second unit, wherein the first and the second units of the inkjet head in each of the first and second arrays are a combination of units configured to supply the nozzles with inks different infrequency of use in non-full color printing and discharge the inks from the nozzles.

6. The inkjet printing apparatus according to claim 3, comprising inkjet heads arranged in first and second arrays, each of the inkjet heads being provided with the nozzle rows of at least the first unit and the second unit, wherein the first and the second units of the inkjet head in each of the first and second arrays are a combination of units configured to supply the nozzles with inks different in frequency of use in non-full color printing and discharge the inks from the nozzles.

* * * * *

UNITED STATES PATENT AND TRADEMARK OFFICE

CERTIFICATE OF CORRECTION

PATENT NO. : 8,820,891 B2
APPLICATION NO. : 14/108969
DATED : September 2, 2014
INVENTOR(S) : T. Bansyo It is certified that error appears in the above-identified patent and that said Letters Patent is hereby corrected as shown below:

In the Claims,

Claim 2 (column 10, line 62), please change “apart” to --a part--.

Signed and Sealed this
Twenty-fourth Day of February, 2015

Michelle K. Lee

Michelle K. Lee
*Deputy Director of the United States Patent and Trademark Office*